US006976486B2

(12) United States Patent
Thoma

(10) Patent No.: US 6,976,486 B2
(45) Date of Patent: Dec. 20, 2005

(54) APPARATUS AND METHOD FOR HEATING FLUIDS

(76) Inventor: Christian Helmut Thoma, The Court House La Grande Route de Sablons Grouville, Jersey (GB) JE3 9FG ( * ) Notice: Subject to any disclaimer, the term of this patent is extended or adjusted under 35 U.S.C. 154(b) by 0 days.

(21) Appl. No.: 10/682,503

(22) Filed: Oct. 10, 2003

(65) Prior Publication Data

US 2004/0194775 A1 Oct. 7, 2004

Related U.S. Application Data

(60) Provisional application No. 60/459,365, filed on Apr. 2, 2003.

(51) Int. Cl.[7] ..... F24C 9/00
(52) U.S. Cl. ..... 126/247
(58) Field of Search ..... 126/26, 247; 122/11; 237/1 R; 416/223 B

(56) References Cited

U.S. PATENT DOCUMENTS

| | | | | |
|---|---|---|---|---|
| 1,149,938 A | | 8/1915 | Nagelvoort | |
| 3,198,191 A | | 8/1965 | Wyszomirski | |
| 3,791,349 A | | 2/1974 | Schaefer | |
| 4,004,553 A | | 1/1977 | Stenstrom | |
| 4,256,085 A | * | 3/1981 | Line | 126/247 |
| 4,277,020 A | | 7/1981 | Grenier | |
| 4,312,322 A | | 1/1982 | Freihage | |
| 4,388,915 A | | 6/1983 | Shafran | |
| 4,424,797 A | | 1/1984 | Perkins | |
| 5,188,090 A | | 2/1993 | Griggs | |
| 5,279,262 A | * | 1/1994 | Muehleck | 122/26 |
| 5,341,768 A | | 8/1994 | Pope | |
| 5,392,737 A | | 2/1995 | Newman et al. | |
| 5,419,306 A | * | 5/1995 | Huffman | 126/247 |
| 5,490,727 A | | 2/1996 | Pöschl | |
| 5,819,724 A | | 10/1998 | Hybertson | |
| 5,913,306 A | | 6/1999 | Moroi et al. | |
| 5,931,153 A | | 8/1999 | Giebeler et al. | |
| 5,970,972 A | * | 10/1999 | Suzuki et al. | 126/247 |
| 6,019,499 A | * | 2/2000 | Selivanov | 366/305 |
| 6,042,017 A | * | 3/2000 | Ban et al. | 237/12.3 R |
| 6,386,751 B1 | | 5/2002 | Wootan et al. | |

FOREIGN PATENT DOCUMENTS

| | | |
|---|---|---|
| GB | 1 217 959 | 1/1971 |
| GB | 2 143 632 A | 2/1985 |
| JP | 60008391 A | 1/1985 |
| JP | 60226594 A | 11/1985 |
| JP | 62213895 A | 9/1987 |

* cited by examiner

*Primary Examiner*—Stephen Gravini
(74) *Attorney, Agent, or Firm*—Young & Thompson

(57) ABSTRACT

An apparatus for heating a liquid comprising a housing having an internal chamber and a rotor disposed in said chamber. A drive shaft rotatably supported in the housing and extending into said chamber for imparting mechanical energy to the rotor. The rotor being provided with a series of openings generally arranged to be parallel to the rotational axis of the drive shaft. The rotor in the form of a disc and the housing formed with radial surfaces on either side of said rotor disc. The rotor may comprise a single disc or alternatively, a series of dics in a liminated formation. A fluid intake passage in said housing preferably arranged adjacent the center of the disc and a fluid exit passage, generally arranged to be circumeferntially outwards of said disc.

28 Claims, 13 Drawing Sheets

APPARATUS AND METHOD FOR HEATING FLUIDS

BACKGROUND OF THE INVENTION

The invention relates generally to the heating of liquids, and specifically to those devices wherein rotating elements are employed to generate heat in the liquid passing through them.

Of the various configurations that have been tried in the past, types employing rotors or other rotating members are known, one being the Perkins liquid heating apparatus disclosed in U.S. Pat. No. 4,424,797. Perkins employs a rotating cylindrical rotor inside a static housing and where fluid entering at one end of the housing navigates through the annular clearance existing between the rotor and the housing to exit the housing at the opposite end. The fluid is arranged to navigate this annular clearance between static and non-static fluid boundary guiding surfaces, and Perkins relies principally on the shearing effect in the liquid, causing it to heat up.

An example of a frictional method for producing heat for warming a fluid is the Newman apparatus disclosed in U.S. Pat. No. 5,392,737. Newman employs conical friction surfaces in order to generate heat, the generated heat passing into a fluid reservoir surrounding the internal elements of the device, and where the friction surfaces are engaged together by a spring and adjustment in the compression of the spring controls the amount of frictional rubbing that takes place.

Such prior attempts at producing heat have suffered for a variety of reasons, for instance, poor performance during operation, and the requirement of complicated and expensive components. Scale build-up is another cost factor should subsequent tear down and refurbishment be then needed. Similarly, because friction materials eventually wear out, they must from time-to-time be replaced.

A modern day successor to Perkins is shown in U.S. Pat. No. 5,188,090 to James Griggs. Like Perkins, the Griggs machine employs a rotating cylindrical rotor inside a static housing and where fluid entering at one end of the housing navigates past the annular clearance existing between the rotor and the housing to exit the housing at the opposite end. The device of Griggs has been demonstrated to be an effective apparatus for the heating of water and is unusual in that it employs a number of surface irregularities on the cylindrical surface of the rotor. Such surface irregularities on the rotor seem to produce an effect quite different than the forementioned fluid shearing of the Perkins machine, and which Griggs calls hydrodynamically induced cavitation. Also known as the phenomena of water hammer in pipes, the ability of being able to create harmless cavitation implosions inside a machine without causing the premature destruction of the machine is paramount. These surface irregularities in Griggs are in the form of deep drilled holes over the length of the cylindrical rotor, and as such, the machining of such deep holes is both time consuming to perform and expensive. The Griggs machine has been shown to work well and is currently known to be used in a number of applications.

An important consideration concerning machinery operating at relatively high temperatures is the protection of bearings and seals against deterioration caused by high temperatures and pressures in the fluid entering and exiting the machine. In the case of Griggs, separate detachable bearing/seal units are deployed, externally attached to the main housing surrounding the rotor in order to space the bearing and seal members well away from the clearance surrounding the rotor. The requirement for such detachable bearing/seal units may increase expense and complication and there therefore is a need for a new solution whereby the effects of high temperatures and pressures are less harmful to such bearings and seals.

Whereas Perkins relies on an impeller to ensure there is always a steady and continuous supply of fluid being drawn through his machine, no such impeller is included in the machine of Griggs. As a result, the Griggs machine is less flexible as it can only perform by relying on a sufficient pressure head of fluid at the input, ie. mains water pressure, or a sufficient head of pressure from above situated holding tank, in order for sufficient fluid is able to make the journey through the annular clearance between rotor and housing. In neither Griggs or Perkins is the fluid itself propelled through the clearance by the action of the rotor rotation.

There therefore is a need for a new solution for an improved mechanical fluid heater, and in-particular where the action of the spinning disc-shaped rotor enables the liquid to be propelled radially outwards from a more central intake in a generally spiral trajectory past a multitude of cavitation implosion zones before reaching the periphery of the rotor.

The present invention seeks to alleviate or overcome some or all of the above mentioned disadvantages of earlier machines, in a device that is relatively simple to implement, preferably with fewer component parts, and or requiring fewer machining operations. The rotating member according to the invention performs with higher efficiency over a wider operating band, relative to the Griggs or Perkins machines. For instance, as the mass of the disc-shaped rotating assembly is potentially far less than the mass of the cylindrically-shaped rotors, it can operate at higher rotational speeds. The greater the rotational speed of the rotor, especially towards the tip of the leading edge, the closer to the speed of sound for improved shock waves by the cavitation implosion zones to maximum power efficiency in performance. As well as by keeping complication to a minimum and avoiding expensive and time-consuming machining operations, there would be advantage if the occurrence of the cavitational effect on the liquid through water hammer could be generated in openings that are relatively short in length, preferably punched or otherwise machined in a disc-like shape comprising a plurality of openings in several rows over the radial width of the disc, where one or more discs could be compactly packaged in the housing for simple economy, and preferably avoiding the detachable bearing/seal units of Griggs.

SUMMARY OF THE INVENTION

It is therefore an object of the present invention to provide a new and improved mechanical heat generator and method of generating heat that addresses the above needs.

A principal object of the present invention is to provide a novel form of water heater steam generator apparatus capable of producing heat at a high yield with reference to the energy input. It is a still further object of the invention to provide a method for doing so.

It is a still further object of the invention to alleviate or overcome some or all of the above described disadvantages of earlier devices and to effect a more efficient propulsion of fluid by a revolving rotor disc or discs for generating an improved shock wave by the cavitational implosion zones disposed over the planer surface of the disc or discs to maximize performance. With respect to a single disc operating inside a housing, the housing wall can preferably provides the static fluid boundary surface for the fluid whereas the planar surface of the disc provides the opposing and dynamic fluid boundary surface. The planar surface is disposed with a plurality of circular arrays of openings or alternatively, at least one spiral array of openings.

It is therefore a preferred feature of the invention that the entry point for the fluid entering the machine is at the center or close of the center coincident with the axis of rotation of the rotor disc. The fluid, on entering the central chamber of the machine and travelling towards the rapidly rotating disc or discs, is propelled radially outwards in a generally spiral path, until it reaches the peripheral outlet to exit the machine. Although some heating of the fluid is likely to occur naturally, due to the shearing effect on the fluid between the static and dynamic opposing fluid boundary surfaces, as well as general turbulence occurring in the passage gap region between these opposing fluid boundary surfaces, the amount of heat created this way is likely to be quite small. Without the formation of a number openings or depressions formed on the disc surface, the fluid would ride across the surface without any effect of water hammer able to take place.

It is therefore an important feature of this invention to include the deployment of numerous openings or cavitation inducing depression zones on one or more surfaces of the rotor disc or discs, facing towards the fluid passage gap region such that the fluid can be hammered during its progress from the centrally located inlet towards the peripheral exit from where it is to be ejected from the machine. As the fluid rides over each opening or depression zone in turn, it is squeezed and expanded by the vacuum pressure conditions occurring in the zone, and the condition of cavitation together with accompanying shock wave behaviour as it traverses across the surface of the disc liberates a release of heat energy into the fluid. Although natural forces such as cavitation vortices are known to occur in nature, the forces to be generated in the present invention are usually viewed as an undesirable consequence in man-made appliances. Such destructive forces, in the form of cavitation bubbles of vacuum pressure, are purposely arranged to implode within locations in the device where they can do no destructive harm to the structure or material integrity of the machine. In this respect, this invention discloses the preferred use of openings or depression zones in the form of a plurality of circular arrays of holes, or at least one spiral array of openings, of increasing number and collective volumetric size with respect to the expanding radial dimension of the rotor taken from its rotation axis towards broadening the occurrence in the number and range of resonant frequencies for an additional influence in the formation of cavitation bubbles. In another respect, certain rotor types are disclosed with a minimum number of openings in bellmouthed configured shapes while other disclose openings having varoius depths and angles of inclination.

It is therefore an aspect of this invention to be able to rapidly and successively alter and disrupt the spiral path of fluid flowing between the rotating and stationary elements in the passage gap region as it passes across these depressions which during operation of the device may become emptied or largely emply vessels of vaccum pressure, and where the deployment of openings or depression zones in the rotating disc assembly acts can divert a quantity of the passing fluid over the disc into these openings or depression zones for the formation of cavitation vortices inside these voids and their attendant shock waves and water hammer effects in the fluid. The fluid once subjected to water hammer returns back to the fluid passage gap region with an increase in temperature and this continues in a continuous process until the fluid eventually reaches the periphery of the disc from where it is directed to exit the device. As such, each of said openings or depression zones becomes in effect individual heating chambers for the device. For certain applications, some or all of such individual heating chambers may be inclined with respect to the longituinal axis of the device or otherwise communicated in series for the creation of an amplified cavitational effect by the device.

As there also would be advantage in being able to take care of a small amounts of wear that may occur over time, it is a preferred feature of the present invention to be able to perform rectification machining, for instance, to ensure the gap height remains at an optimum figure, such that surface grinding of the face or faces of the disc assembly, or skimming of the housing interior on a laith tool, can be undertaken, simply and cheaply, without the need to replace and exchange whole components (as would be the case with wear on a cylindrical rotor).

According to the invention in another respect, although it is be preferred that the opposing wall facing the cavitation inducing depression zones be arranged to be spaced apart at a fixed distance with respect to the disc assembly, this parallel configuration may be modified to suit particular applications and conditions. For intance, the opposing wall or walls may alternatively be arranged so as to be inclined with respect to the planar surface of the disc, the spacing being greatest near to the central axis of the device and least at the periphery of the disc, or vice versa. As example, a greater spacing nearer the periphery of the disc may be used for certain applications and help assist the expulsion of steam from the device when it is to be used as a steam generator.

In one form thereof, the invention is embodied as an apparatus for the heating of a liquid such as water, comprising a static housing having a main chamber with fluid entry and exit connections. The chamber of the housing contains a rotor in the form of at least one disc element disposed in said chamber and dividing said chamber into first and second passage gap regions, the first passage gap region lying axially to one side of said disc element and the second passage gap region lying to the opposite side of said disc element. A drive shaft having a longitudinal axis of rotation extends through said chamber for imparting mechanical energy to said rotor assembly, the drive shaft being rotatably supported in the housing by a pair of bearings to provide rigid support for the rotor wherein a respective bearing lies adjacent each end of the rotor. The fluid inlet connection is disposed to lie substantially near to said longitudinal axis whereas the fluid outlet connection is disposed to lie substantially radially outwardly of said rotor. Rotation of said disc acts in causing fluid to move outwardly from said fluid inlet connection and across at least one of said first and second passage gap regions to reach said fluid outlet connection, and wherein said rotor includes a series of openings facing towards at least one of said first and second passage gap regions, and the fluid, as it passes a multitude of cavitation implosion cavites is caused to heat up during its transit. The rotor assembly is preferably engaged to the drive shaft by means of a screw thread.

Preferably mains water pressure or the source tank situated above the height of the device can be used to provide the device with water at the inlet connection.

Other and further important objects and advantages will become apparent from the disclosures set out in the following specification and accompanying drawings.

BRIEF DESCRIPTION OF THE DRAWINGS

The above mentioned and other novel features and objects of the invention, and the manner of attaining them, may be performed in various ways and will now be described by way of examples with reference to the accompanying drawings, in which.

These figures and the following detailed description disclose specific embodiments of the invention; however, it is to be understood that the inventive concept is not limited thereto since it may be incorporated in other forms.

DETAILED DESCRIPTION OF THE FIRST ILLUSTRATIVE EMBODIMENT OF THE INVENTION

Figure 1:
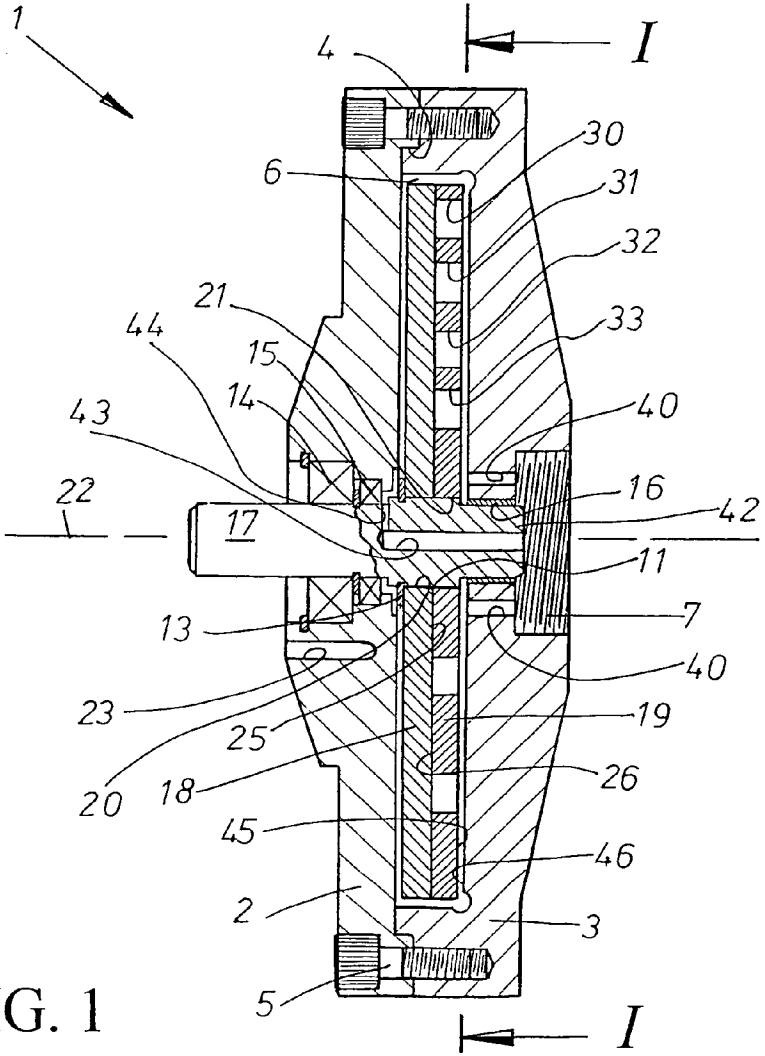
FIG. 1 is a longitudinal sectional view of a device in according to the first embodiment of the present invention.

Referring to FIG. 1, the device, denoted by reference numeral 1, has a housing structure comprising two elements 2, 3 registered together at 4 and where a plurality of fastening screws 5 hold housing elements 2, 3 together. The housing members 2, 3 form internal chamber 6.

Figure 2:
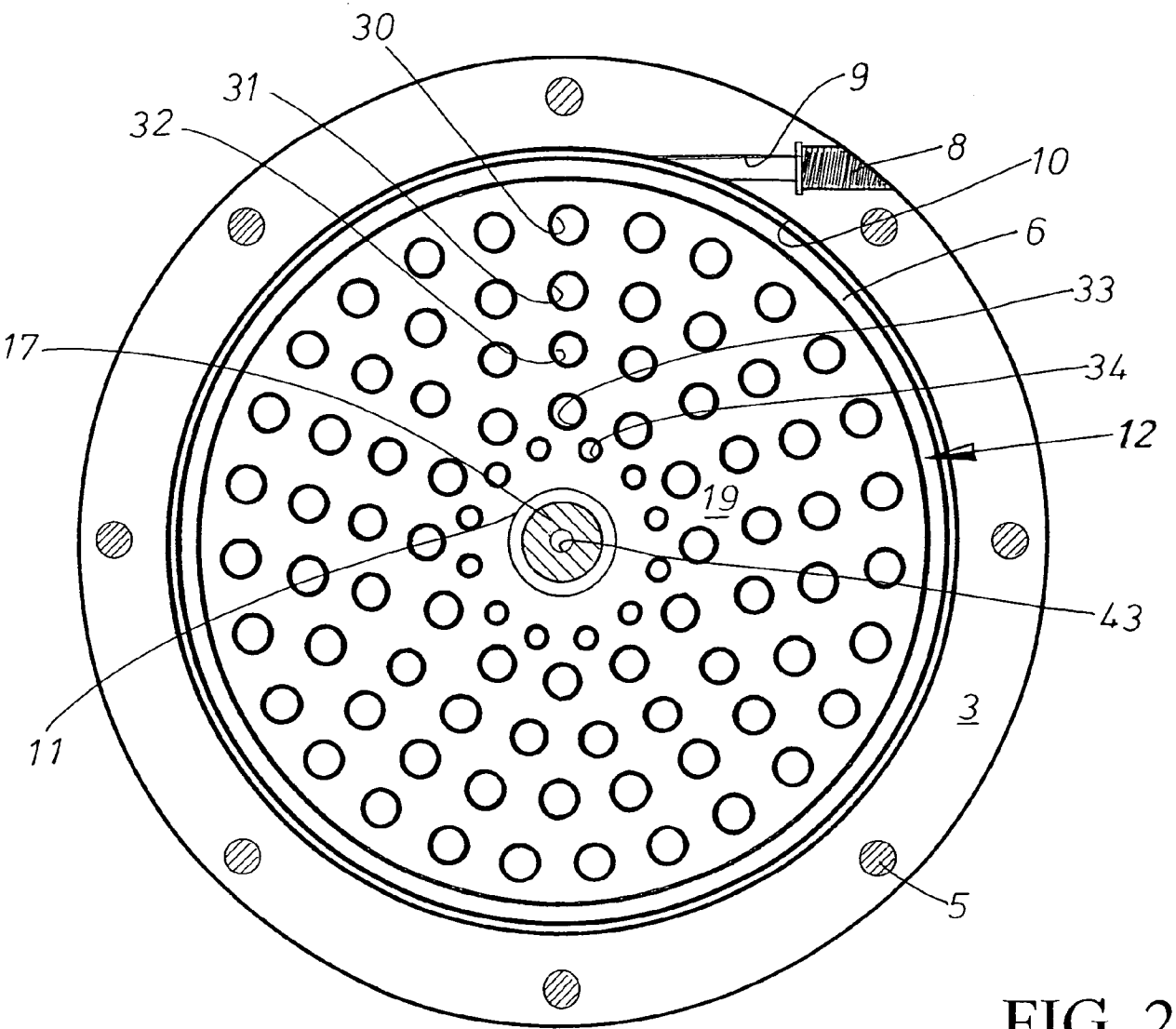
FIG. 2 is a transverse sectional view of the device taken along line I—I in FIG. 1.

Housing element 3 includes a centrally located inlet passageway 7 and a radially positioned exit passageway 8 best viewed in FIG. 2. Exit passageway 8 communicates with internal chamber 6 via hole 9 and where hole 9 connects with a circumferencial liquid capturing groove 10 formed in the interior of housing element 3 and which is shown radially outwardly to one side of the rotor disc assembly which is depicted by arrow 12. Both passageways 7, 8 are shown located in the same housing element 3, and preferably, both passageways are threaded so that standard hydraulic connections can be used to couple the device 1 to pipe work. Cool liquid from some external source enters the heating apparatus at inlet 7 and once heated by the action of the rotating rotor disc assembly 12, exhausts at exit 8 in either the form of heated liquid or steam.

Housing element 2 has a bearing 14 and seal 15 surrounding drive shaft 17 of the device 1, and where drive shaft 17 protrudes out from one side of the housing member 2 to be connected to an external drive source such as an electric motor. Drive shaft 17 rotates about longitudinal axis 22 which is shown lying coincident with the center of inlet passageway 7. Although by no means essential, it can nevertheless be desirable for the drive shaft to be driven by a contant speed electic motor. Drive shaft 17 is extended to enter into internal chamber 6 and extends towards preferably, a second bearing 16 is located in housing element 3 to provide further support for said drive shaft 17 and rotor assembly 12. Although by no means essential, it is preferable however, that bearings 14, 16 and seal 15 are disposed in the housing rather than located in separate detachable bearing/seal units as deployed in Griggs, and which in any case would require the additional expense of a further seal. Referring to FIG. 1, because drive shaft 17 supported by bearings 14, 16 in housing elements 2, 3 respectively, the rotor disc assembly is not held by the drive shaft in a cantilevered state. Although by no means essential, it is however to be preferred for rotor disc assembly 12 to be supported at both sides by bearings 14, 16. As a result, the potential output rating can be higher and/or with an increased longevity of the component parts such as the bearings. Although by no means essential, it is however preferable that the rotor disc assembly 12 be fastened to drive shaft 17 in a cost effective manner whereby wear between these mating parts due to fretting and general mechainical vibration is minimized. Accordingly, it is a preferred feature of the invention that the dual support provided for drive shaft 17 via bearings 14, 16 in respective housing elements 2, 3 is exploited fully by threading the rotor disc assembly 12 onto a threaded portion of the drive shaft at the interface denoted by numeral 11. A snap ring or circlip 13 located on the threaded portion of drive shaft 17 sets the axial position of rotor disc assembly 12 on drive shaft 17 in one axial direction and it is preferred practice that the thread at interface 11, be it left or right handed, is dependent on the rotational direction of drive shaft 17 such that rotation acts in tightening rather than unwinding the rotor disc assembly 12 to the drive shaft 17. Although not shown, a further snap ring or circlip on drive shaft 17 could be disposed on the opposite side of the disc assembly. Any play occurring at interface 11 may be eliminated by applying a vibration damping surface costing and or a thread locking compound at interface 11 such as are readily obtainable from the range of products marketed by the Loctite Company.

As described for this particular embodiment, the rotor disc assembly 12 comprises a flat disc-shaped plate element 18 and a perforated disc-shaped element 19 and where each element is provided with a respective central aperture 20, 21 and which are provided with a female thread. In the case of a perforated disc-shaped element being fabricated by punching out the openings, the precise depth of openings is automatically achieved for a perfectly blanced rotor. Although disc elements 18, 19 may be joined together by welding or by other means such as retaining screws, preferably the action of the disc elements 18, 19 being fastened onto drive shaft 17 at interface 11 is the most cost effective manner for meeting many of the typical applications where the device is to be used. Both the surface 25 of disc element 18 as well as the opposing surface 26 of disc element 19 may be provided with a ground finish to ensure a good seal at the joining interface, or alternatively, the surfaces may be glued together by, for instance, an anaerobic bonding compound.

Perforated disc element 19 is provided with a plurality of openings in the form of several circular rows of holes indictated in FIG. 2, the outermost circular row of holes being denoted by reference numeral 30. Adjacent circular rows of holes are denoted by reference numerals 31 32, 33, and in order to shown that such openings need not all be of equal diameter, depicted for the innermost circular row of holes closest to longitudinal axis 22, are smaller diameter holes 34. Preferably, more than one circular row of such openings of any particular suitable size is disposed on said perforated disc in order to make efficient useage of the available surface area of the disc as well as maximizing the effect on the passing fluid produced by having such numerous cavitation inducing depression zones.

The threaded fluid inlet connection referred to above as the inlet passageway 7 is shown connected via two or more fluid ports 40 in the form of drilled holes in housing element 3 with internal chamber 6. These fluid ports open in to internal chamber 6 adjacent the surface of perforated disc element 19 and purposely much nearer to the root of the rotor than to the tip of the disc. The size of threaded fluid inlet connection as shown allows access for a drill to be inserted for the machining of the fluid ports 40. However, the fluid inlet configuration can be altered in a number of ways, for instance whereby just one fluid port is used, and where the single port is arranged to extend right through housing element 3 and its end threaded or otherwise made available for connection to the supply pipe for the device. In this case, the requirement for having the centrally located an inlet passageway 7 is eliminated.

As best seen in FIG. 1, it is preferably although for this embodiment not essential that the inner end of drive shaft 17, denoted by reference numeral 42 and which is supported in housing element 3 by bearing 16, is drilled to a certain distance along the longitudinal rotational axis 22 of drive shaft 17. The longitudinally drilled hole is shown as hole 43 and this hole is arranged to connect with at least a single radially configured drilled hole denoted by reference numeral 44 which is also disposed in drive shaft 17. In this embodiment, a relative small amount fluid from inlet passageway 7 is allowed to travel via holes 43, 44 in drive shaft 17 to enter internal chamber at a location adjacent seal 15 for the purpose of cooling and lubricating this location. Furthermore, a series of cavities 23 may be cast on the face exterior of housing element 2 close to bearing 14 and seal 15 as a further contributory measure towards keeping these components cooled. As the bulk of fluid is passing through the device 1 via fluid ports 40 which are positioned radially outwards of bearing 16, this provides a cooling stream of fluid close to the neighbourhood of this bearing 16. The cooling of bearing 16 may be further assisted by the flow of cool fluid entering longitudinal hole 43 at the end 42 of drive shaft 17. As bearing 16 is positioned close of the fluid entry connection to the device, it remains largely unaffected by any heat build-up in other areas of the device. The type bearing 16 is preferably a steel backed PTFE lead lined composite bearing although other bearing types may be used, and as the end 42 of drive shaft 17 lies next to inlet passageway 7, unlike Griggs, there is no requirement for sealing the device at this side of the housing.

Fluid enters the device 1 at inlet 7 in the direction of perforated disc element 19 and the fluid passing through fluid ports 40 comes into contact with the fast revolving rotor disc assembly 12 to be rapidly propelled radially outwards in a spiral path across the surface of perforated disc element 19. This surface denoted by reference numeral 45 on perforated disc element 19 as shown in FIG. 1 is the first fluid boundary defining surface for the fluid entering this zone of the internal chamber 6, and the adjacent surface provided by the interior wall of housing element 3 and denoted by reference numeral 46 in FIG. 1 is the second fluid boundary defining surface for the fluid entering this zone of internal chamber 6.

The liquid in the gap between the first and second fluid boundary surfaces is caused by the fast rotating rotor disc assembly 12 to move in a generally radially spiralling direction towards circumferential groove 10 and during its manoeuvring across the face 45 of the perforated disc element 19, it is subjected to water hammer due to having to travel across the various rows of holes acting as low or negative pressure depression zones for inciting the cavitational behaviour in the liquid, starting with the innermost circular row 34, and ending with the outermost circular row of holes 30. On reaching groove 10, the liquid is tangentally expelled from the device 1 via hole 9 to exit the device at outlet passageway 8 at a higher temperature value than when first entering the device at 7.

Figure 3:
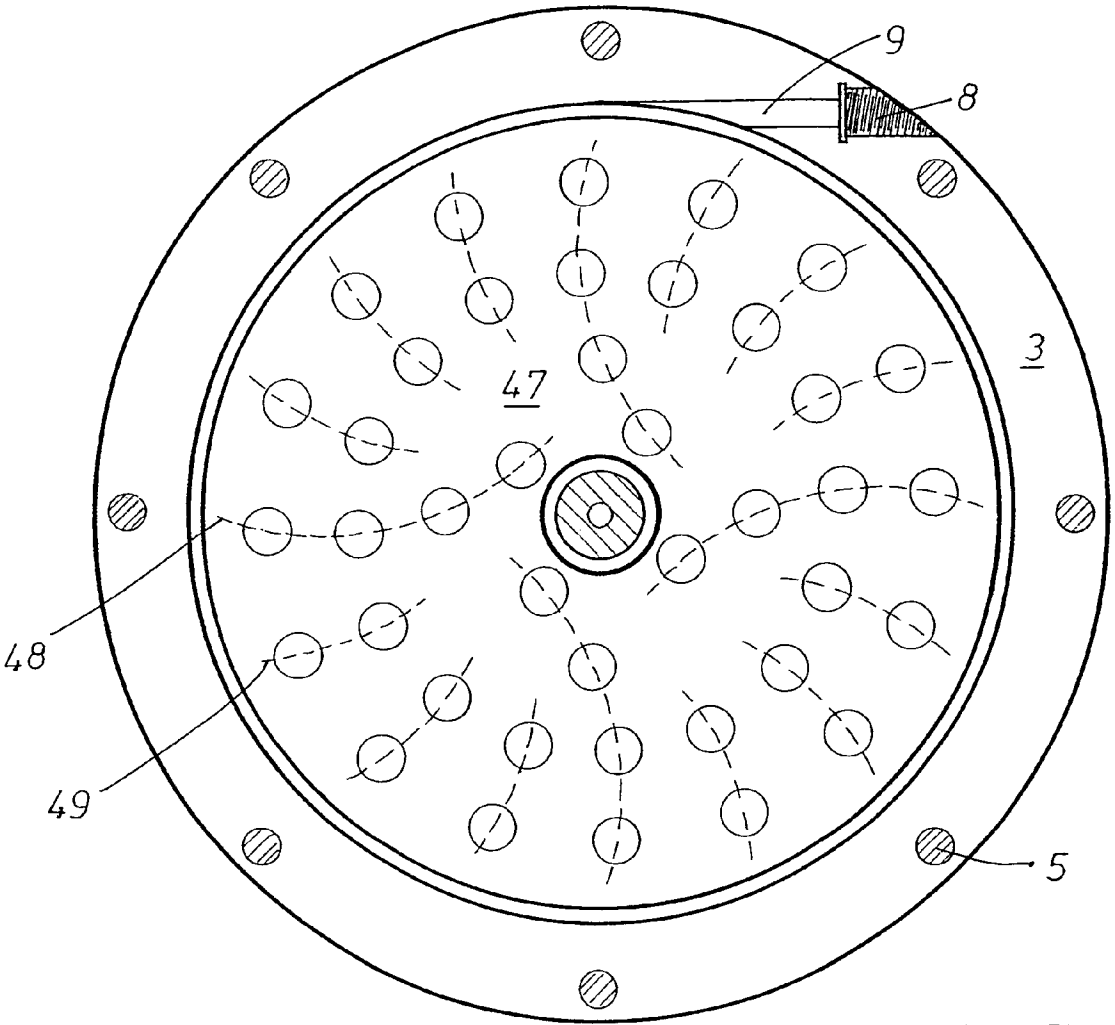
FIG. 3 is an alternative rotor disc in the transverse sectional view of the device of FIG. 1 taken along line I—I in FIG. 1.

FIG. 3 discloses an alternative configuration for the cavitation inducing depression zones, and in order to contrast with the five circular rows of holes depicted in FIG. 2, here the holes are arranged on perforated disc element 47 in four waves each comprising four holes denoted by reference numeral 48 and twelve waves each comprising two holes and denoted by reference numeral 49. Although as shown, the rotational direction of the disc element 47 is clockwise to ensure the best exit direction for the fluid entering into exit 8, this is not meant to convey the impression that the waves need to be orientated soley in the manner as shown. For instance, the shapes of such wave formations may be reversed with respect to the position of the exit 8 or the curvature of each such wave formations may be changed to suit a particular operational requirement such as shaft speed.

DETAILED DESCRIPTION OF THE SECOND EMBODIMENT OF THE INVENTION

Figure 6:
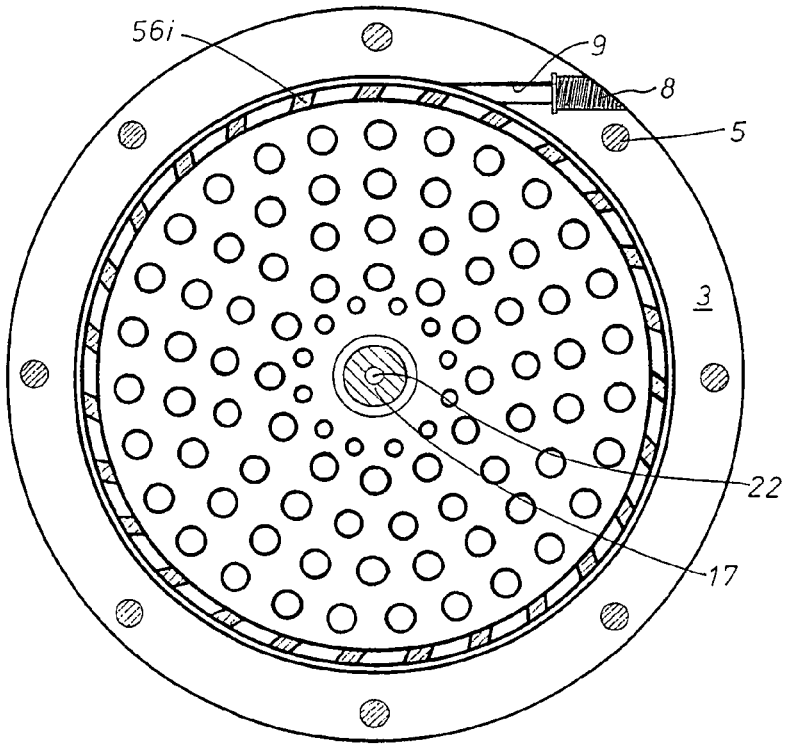
FIG. 6 is an alternative rotor disc in the transverse sectional view of the device of FIG. 5 taken along line II—II in FIG. 5.
Figure 7:
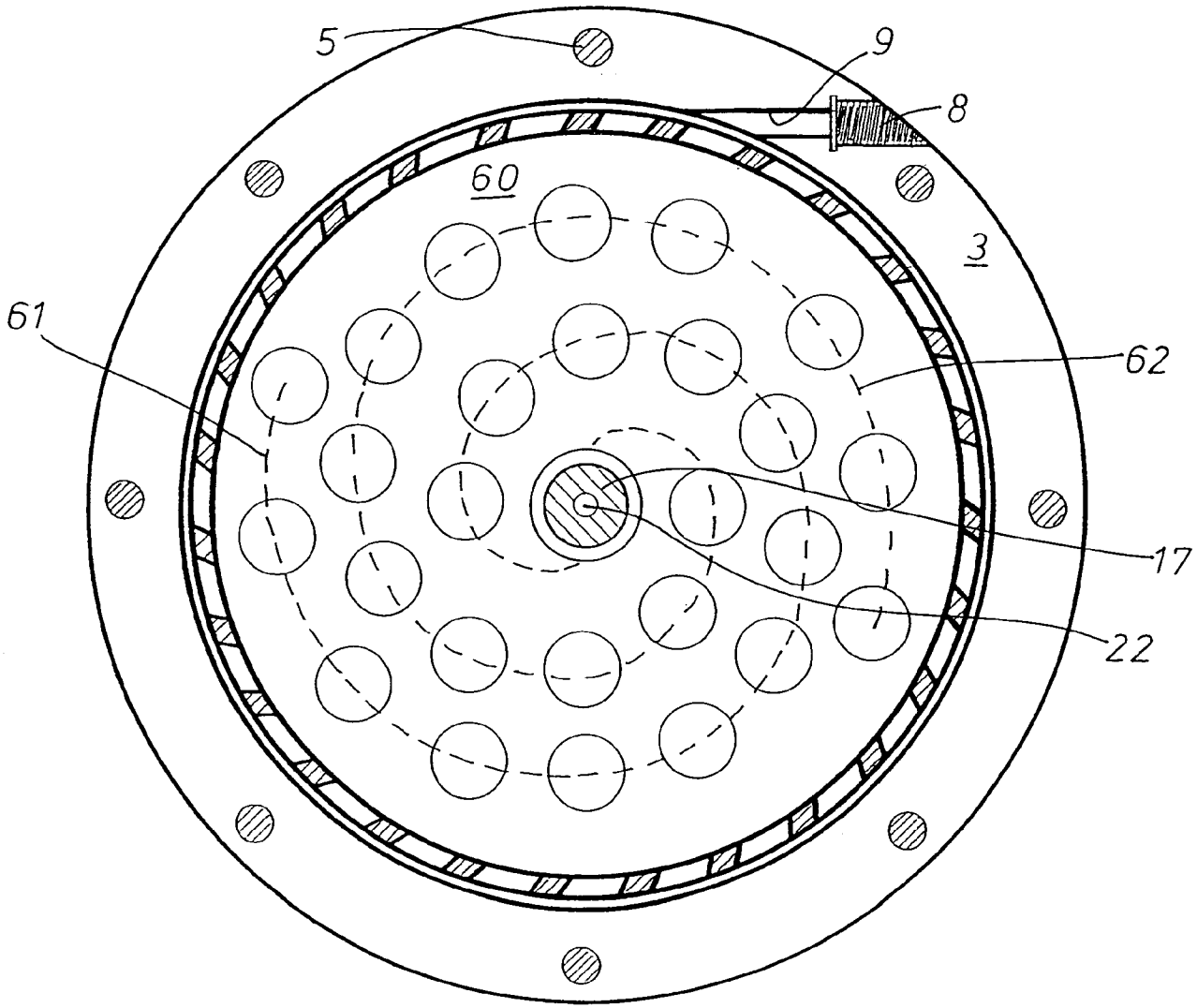
FIG. 7 is an alternative rotor disc in the transverse sectional view of the device of FIG. 5 taken along line II—II in FIG. 5.
Figure 8:
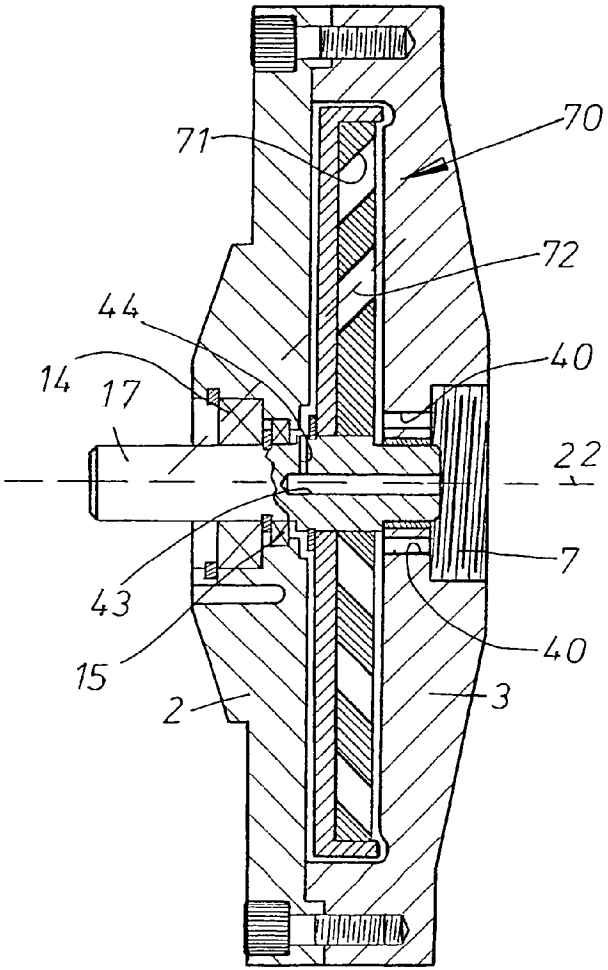
FIG. 8 is a longitudinal sectional view of a device of FIG. 4 with an alternative rotor disc.

This embodiment of the present invention, depicted in FIGS. 4 to 8 differs in two major respects from the previously described first embodiment, firstly, that the rotor disc assembly is provided with a series of vanes, and secondly, specific to FIG. 8 where the parallel-walled holes are arranged to be inclined with respect to axis 22. As many of the other features of this embodiment are common to those already described, description is only necessary to show the main points of difference between these two embodiments of the invention. Further, as many of the components are identical to those described for the first embodiment, they carry the same same reference numeral.

Figure 5:
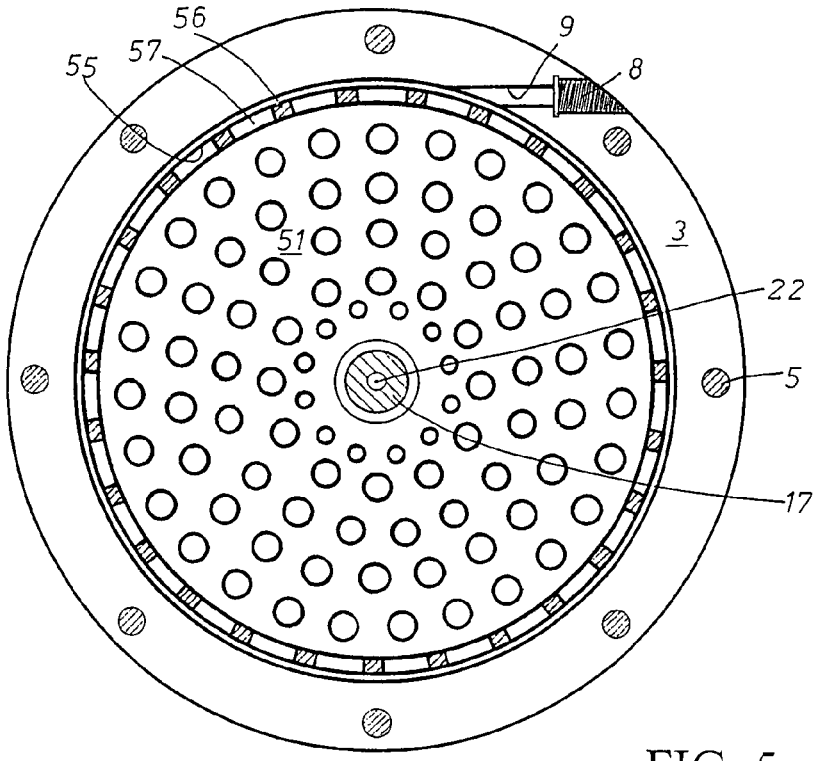
FIG. 5 is a transverse sectional view of the device taken along line II—II in FIG. 4.

The rotor disc assembly here denoted by arrow 50 is comprises of a perforated disc-shaped element 51 and an adjacent non-perforated element 52 referred to as the carrier element. The carrier element 52 really only differs from the flat disc-shaped plate element of the first embodiment in that it is provided with an integral rim portion 55 that is arranged to exend beyond the axial width of perforated element 51, and where the extention portion carries a series of vanes best seen as vanes 56 in FIG. 5. To simplify manufacturing, such vanes 56 may be formed by cutting the rim 55 by machining a series of radial slots 57 with an end mill. As shown in FIG. 5, vanes 56 are generally orientated towards longitudinal axis 22 whereas as an alternative deployment for such vanes, vanes 56i in FIG. 6 are shown angled more pronouncely towards hole 9. The purpose of including such vanes 56 or 56i is to provide a deflection surface on the rotor disc assembly for the heated liquid or expanding steam moving towards exit 8 to impart on the vanes a small impulse towards the momentum of the rotating disc and shaft.

Figure 4:
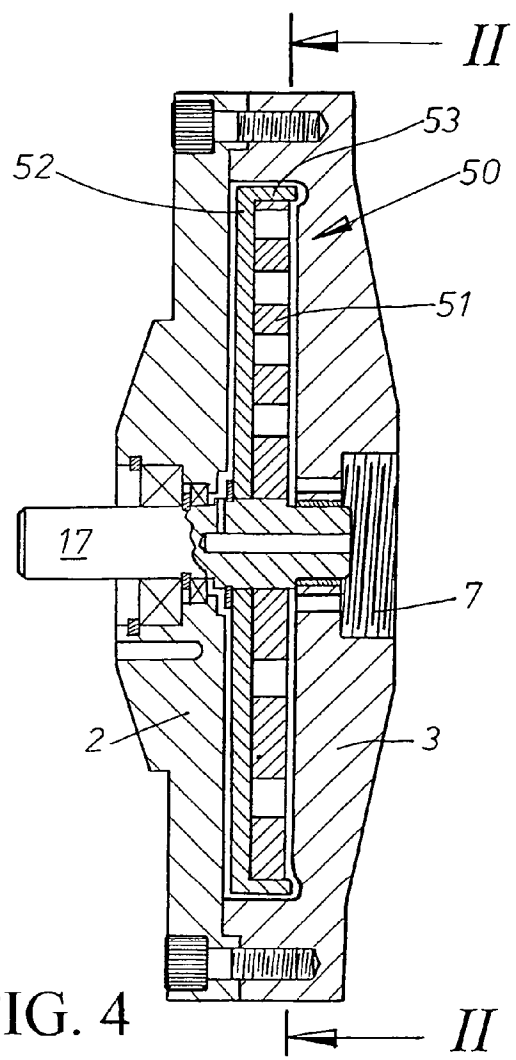
FIG. 4 is a longitudinal sectional view of a device in according to the second embodiment of the present invention.

Whereas the perforated disc-shaped element 51 shown in FIGS. 4, 5 & 6 has the very same arrangement of openings as for the first embodiment, namely five circular rows of parallel-walled holes disposed parallel with respect to axis 22, an alternative rotor disc as shown in FIG. 7 discloses an alternative configuration for such cavitation inducing depression zones wherein such parallel-walled holes are arranged in two spiral rows shown as spiral set 61 and spiral set 62 respectively.

Although as shown, the direction of the spirals is clockwise, however this is not meant to convey the impression that these spiral sets need to be orientated soley as shown. For instance, the rotation of the spirals may be reversed, or the number varied from a single spiral set to more than the two spiral sets as shown.

As a further variation, FIG. 8 discloses an alternative rotor assembly denoted by reference arrow 70 wherein the cavitation inducing depression zones in the form of parallel-walled holes 71 are arranged such that their longitudinal axes 72 are inclined with respect to the longitudinal axis 22 of drive shaft 17. Preferably, the inclination of such holes is in a direction towards the tip of the disc as is here shown. Furthermore, although here not shown, the longitudinal axis of each such hole may be drilled at an oblique angle so that the holes are angled in a direction facing towards or away from the directional rotation of the disc. Inclining the axis of such cavitation inducing depression zones in one or more plane orientations provides a smoother route for the liquid or steam contained in each zone to be propelled outwardly due to centrifical forces acting in that region. An advantage of such angled holes 71 where they break out on the surface of the disc 70 is that the corner or edge of the hole is less prone to erosional wear, especially true in the case when the device is used to produce steam.

DETAILED DESCRIPTION OF THE THIRD EMBODIMENT OF THE INVENTION

Figure 9:
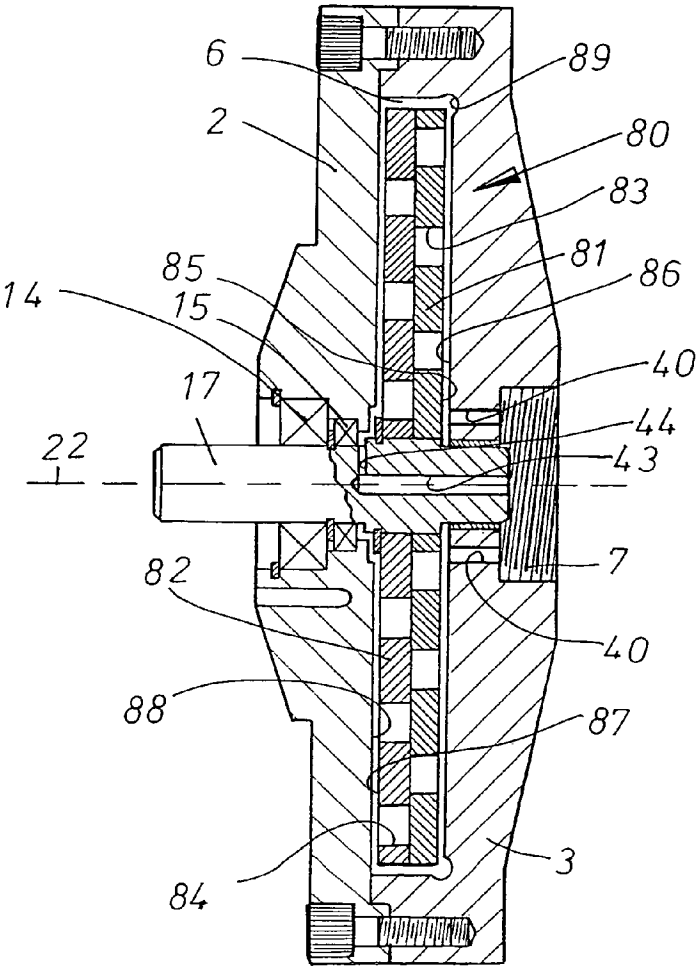
FIG. 9 is a longitudinal sectional view of a device in according to the third embodiment of the present invention.

This embodiment of the present invention depicted in FIG. 9 differs with respect of the previously described embodiments in that the rotor disc assembly is comprised of two disc that in this case are both perforated, and where the relative position of the perforations in each disc are preferably staggered to the extent necessary in order that the holes are prevented from overlapping each other at the interface between the repective discs. The rotor disc assembly denoted by arrow 80 comprises a first perforated disc-shaped element 81 and a second perforated disc-shaped element 82, first perforated disc-shaped element 81 is provided with a plurality of openings denoted by reference numeral 83 and second perforated disc-shaped element 82 is provided with a plurality of openings denoted by reference numeral 84.

A proportion of the fluid entering the device at inlet 7 passes through fluid ports 40 towards surface 85 of fast revolving first perforated disc-shaped element 81 to be rapidly propelled radially outwards in a spiral path across this surface. The surface 85 is the first fluid boundary defining surface and the adjacent surface provided by the interior wall of housing element 3 and denoted by reference numeral 86 is the second fluid boundary defining surface. Fluid from inlet 7 entering the interior of the drive shaft 17 via holes 43, 44, although like the prior embodiments which cools and lubricate the region adjacent seal 15, here in addition is used to provide fluid for second perforated disc-shaped element 82. As such, the gap distance between the housing element 2 and second perforated disc-shaped element 82 would preferably be greater is size than that strictly required for embodiments of the invention where the fluid boundary surfaces are soley disposed on the opposite side of the rotor disc assembly.

Fluid coming towards surface 87 of fast revolving first perforated disc-shaped element 82 is rapidly propelled radially outwards in a spiral path across its surface. The surface 87 is the third fluid boundary defining surface and the adjacent surface provided by the interior wall of housing element 3 and denoted by reference numeral 88 is the fourth fluid boundary defining surface. Once the heated fluid has travelled past the rotor disc assembly 81, the fluid moves towards the point referred to in FIG. 9 by reference numeral 89 which is the inner end of hole 9 communicating with exit passageway 8 as shown in the earlier embodiments.

DETAILED DESCRIPTION OF THE FOURTH EMBODIMENT OF THE INVENTION

This embodiment of the present invention, depicted in FIGS. 10 to 13 differs in two main respects from the previously described first embodiment in that the rotor disc assembly is a single component element and where the cavitation inducing depression zones are no-longer configured in the form of parallel-sided holes. In the example here shown, the openings are bellmouthed and where they provide a large surface area at the surface of the disc rotor for the minimum distance of penetration, useful as the axial width of the the disc is small as compared to its diametrical size. The bellmouthed shape may easily be produced using the tip of a drill although a part-spherical shape using ball-nosed end mill cutter could be used to provide an acceptable alternative shape for such openings. The term bellmouthed is therefore intended to cover other shapes for the cavity of the opening that are unlike the parallel-sided holes shown for the openings shown in the other drawn embodiments of the present invention.

As other features are all very similar to the first embodiment, description is only necessary to show the main points of difference. Further, as many of the components are identical to those described for the first embodiment, for convenience sake, most that are here numbered carry the same reference numerals as were used for described the first embodiment.

Figure 11:
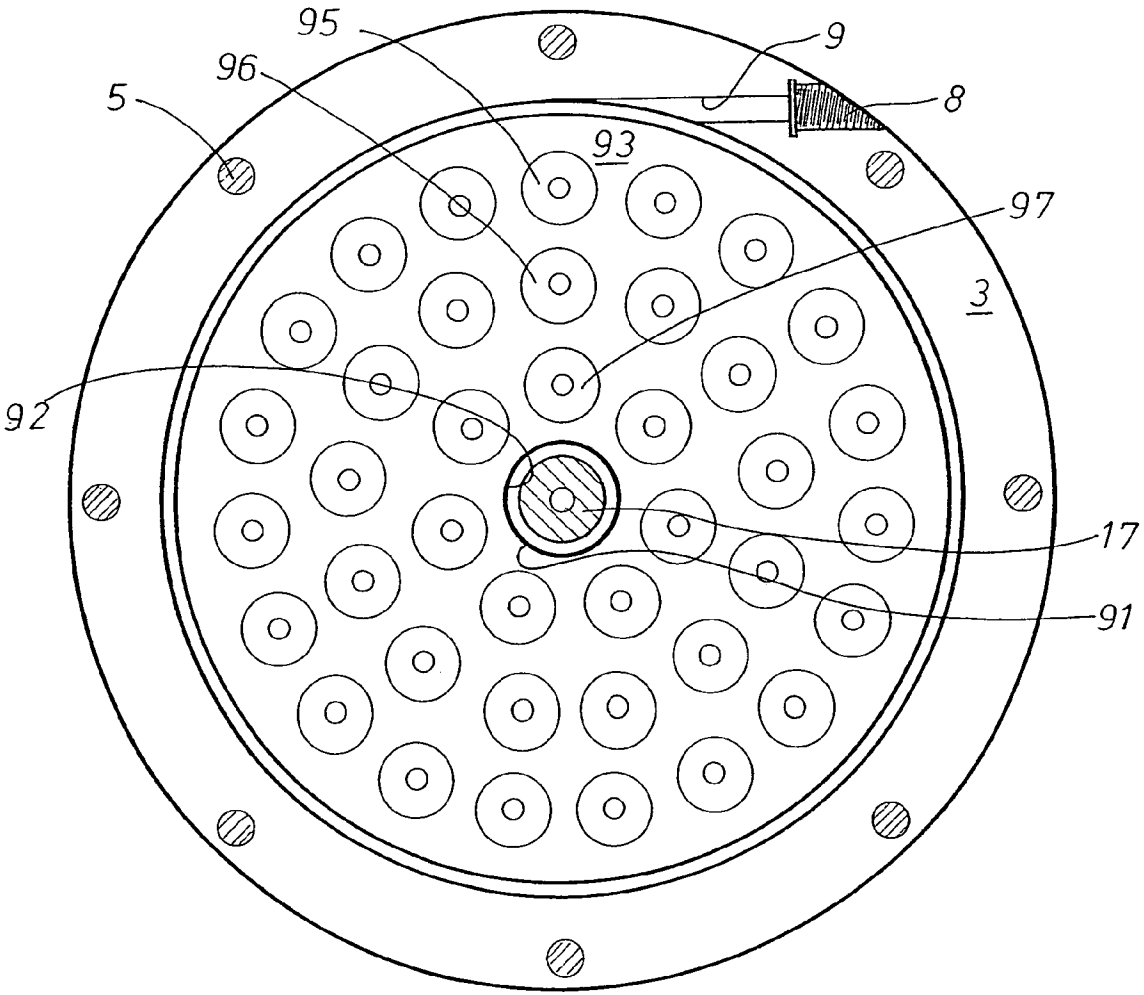
FIG. 11 is a transverse sectional view of the device taken along line III—III in FIG. 10.

Rotor disc 90 preferably is a one-piece component provided with a female threaded central bore 91 that is screwed into position on male thread 92 provided on drive shaft 17. Although only one surface shown as 93 of disc 90 is here shown incorporated with a number of bellmouth-shaped openings, in FIG. 10 here indicated as outermost set of openings 95, the opposite surface 94 could equally be provided with a number of such bellmouth-shaped openings in a staggered manner similar to that already described in the third embodiment of the invention. Referring to FIG. 11, the disc surface 93 is shown provided with three circular rows of openings, the outermost indicated as openings 95, the intermediary set as openings 96, and the innermost set as openings 97. Taking outermost row of opening 95 in FIG. 10 by way of example, the shape is bellmouthed 98 from the surface 93 of the disc 90 and includes a relatively short length of drilled hole 99. By way of comparison, the number of such bellmouthed-shaped openings is thirty-nine which compares with the number of seventy-eight circular openings of the parallel hole type for the first embodiment in FIG. 2 (not counting the innermost circular row of smaller openings). Therefore bellmouthing provides a cost-effective measure for reducing machining time by reducing in number the number of machining operations required in fabricating the disc.

Figure 12:
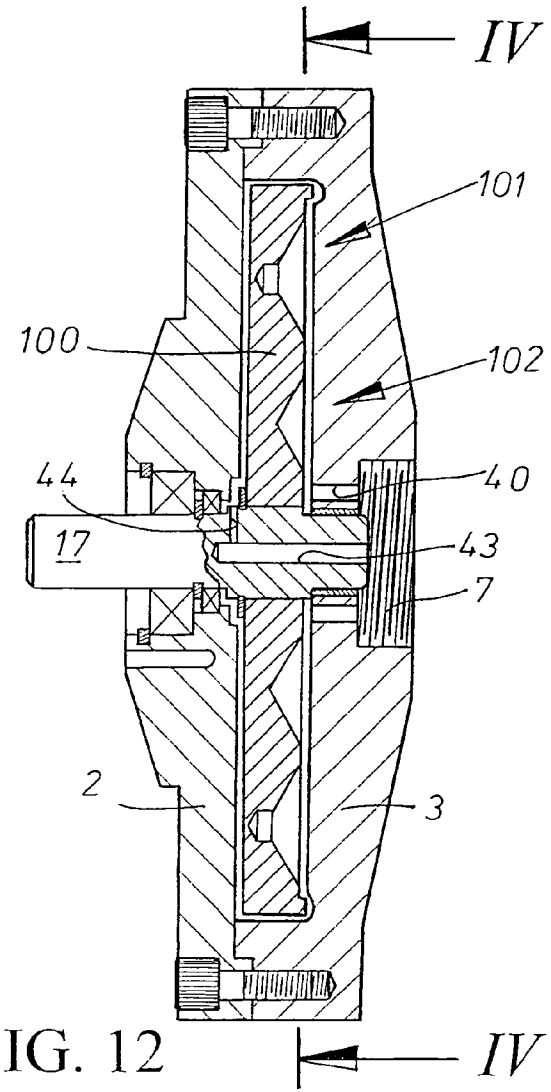
FIG. 12 is a longitudinal sectional view of a device of FIG. 10 with an alternative rotor disc assembly.
Figure 10:
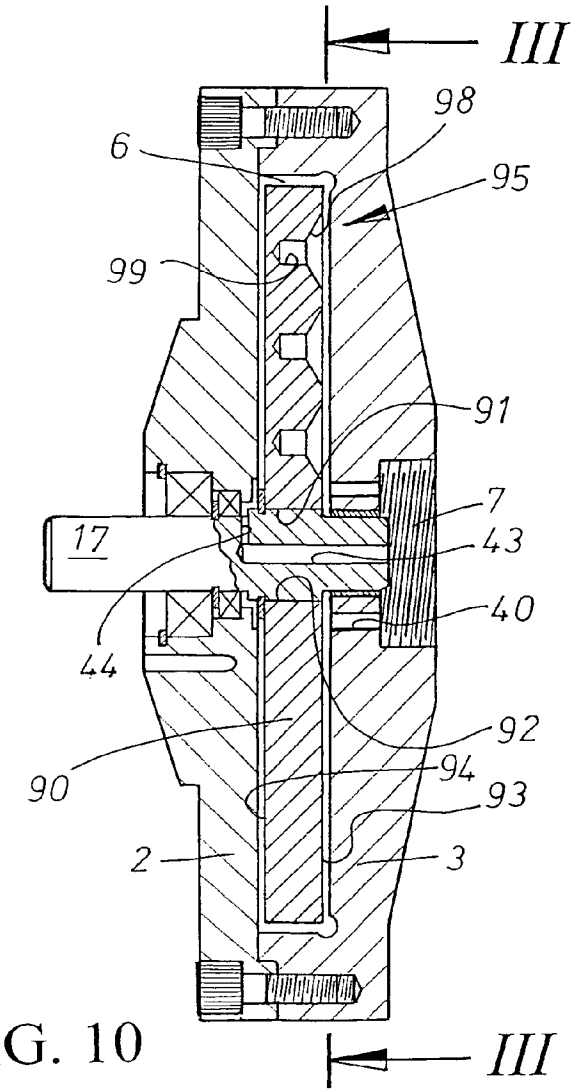
FIG. 10 is a longitudinal sectional view of a device in according to the fourth embodiment of the present invention.
Figure 13:
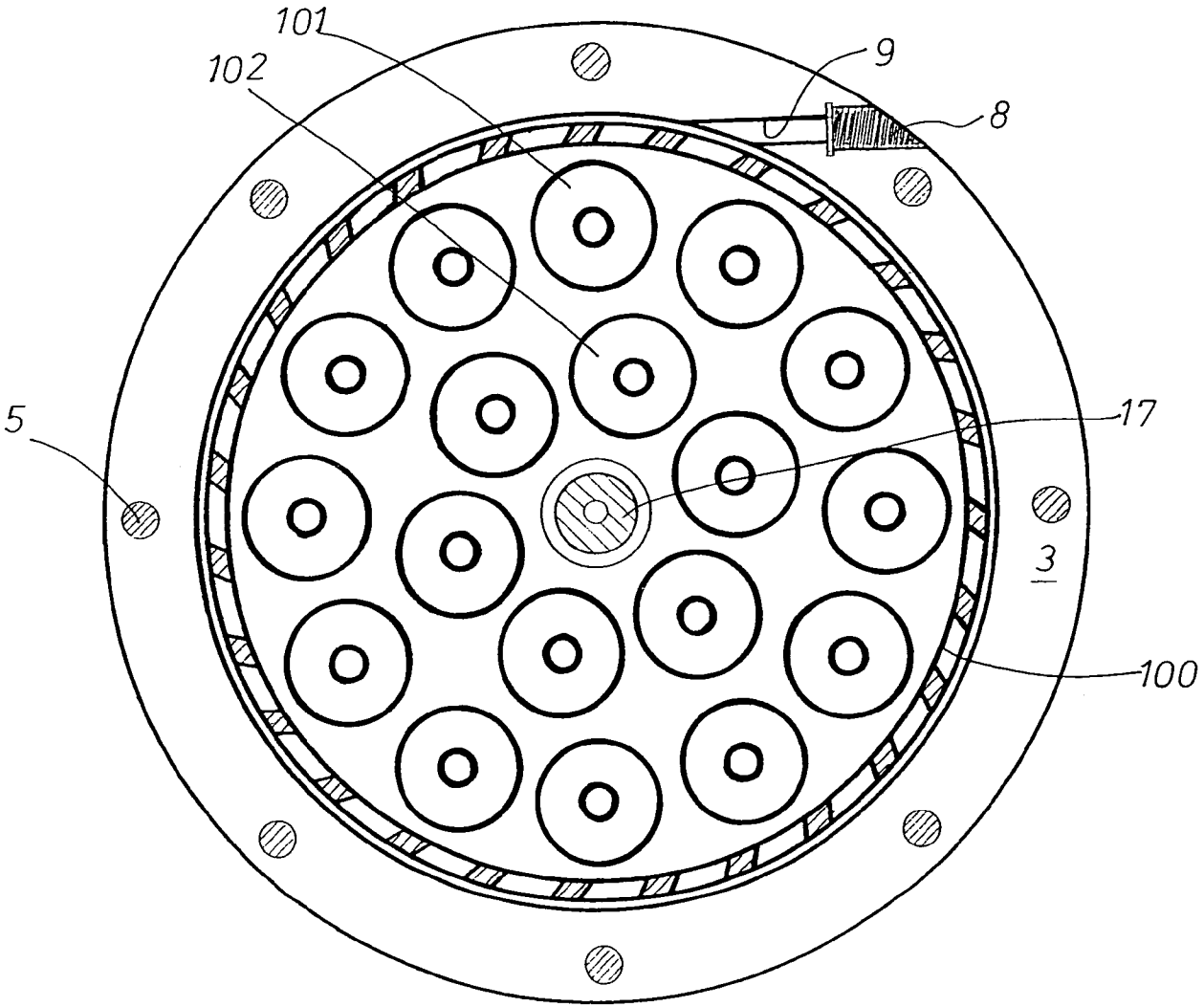
FIG. 13 is a transverse sectional view of the device taken along line IV—IV in FIG. 12.

FIGS. 12 & 13 take this feature of the invention a step further. Here one-piece disc rotor component 100 is provided with just two circular rows of openings, the outer set indicated as bellmouthed openings 101 and the inner set of bellmouthed openings as 102. With twelve bellmouthed openings 101 in the outer set and six bellmouthed openings 102 in the inner set, this disc 100 therefore require only eighteen openings which makes for considerable savings in production time. Based on surface area alone, this measure can be used to massively increase the exposure of the liquid to cavitation without having to deploy so many openings as are shown in earlier embodiments.

DETAILED DESCRIPTION OF THE FIFTH EMBODIMENT OF THE INVENTION

Figure 14:
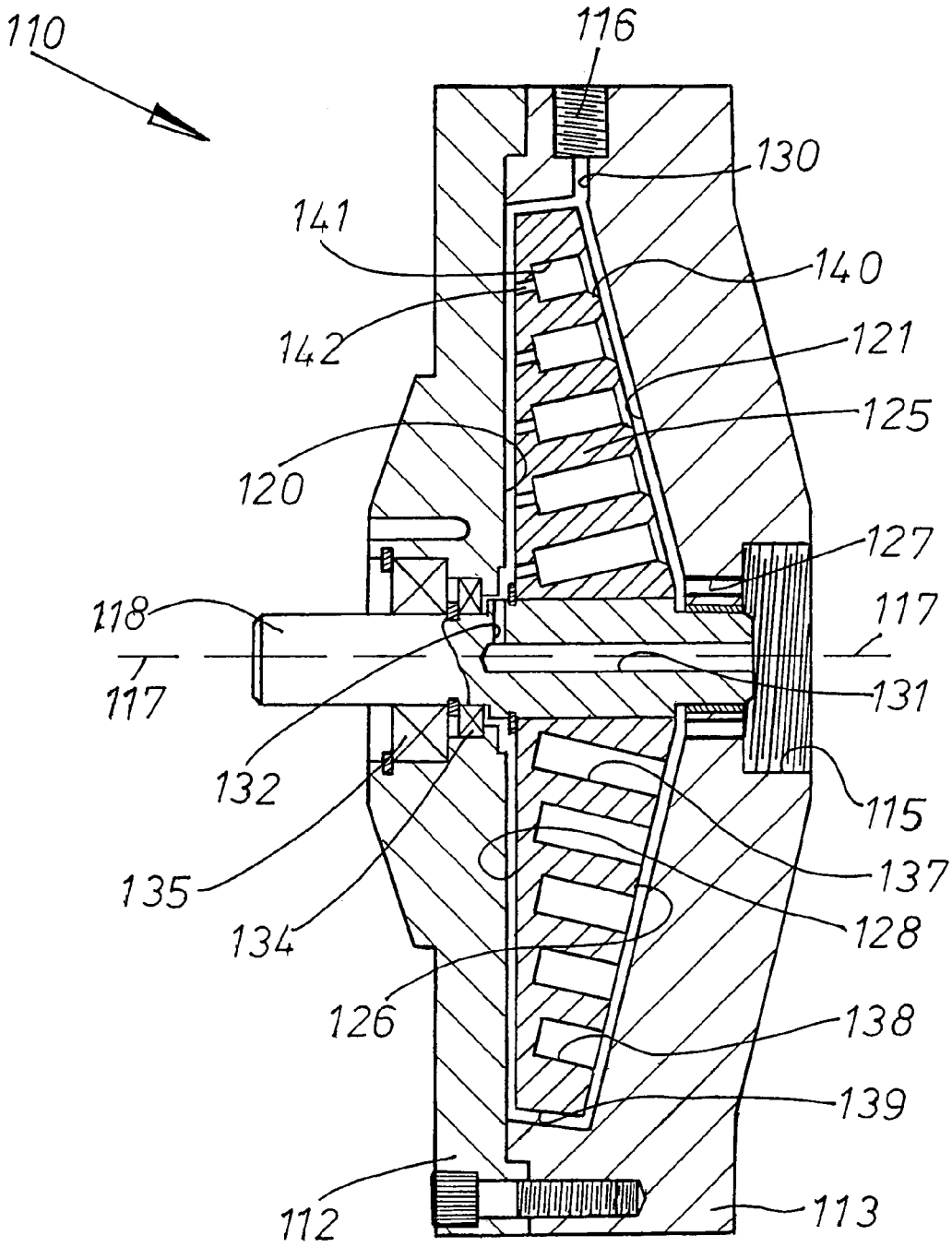
FIG. 14 is a longitudinal sectional view of a device in according to the fifth embodiment of the present invention.

As depicted in FIG. 14, the device denoted by reference numeral 110 has a housing structure comprising two elements 112, 113. Housing element includes a centrally located inlet passageway 115 as well as a radially positioned exit passageway 116, shown here extending perpendicular to the longitudinal rotational axis 117 of drive shaft 118. When housing elements 112, 113 are combined, respective internal wall surfaces shown 120, 121 form an internal chamber in which the rotor disc member 125 is positioned. As in the case of the earlier embodiments, disc member 125 may be fastened to drive shaft 118 on a thread or by other attachment means. Disc member 125 is provided with a bevelled surface 126 on its side nearest fluid ports 127 and inlet 115, and a generally flat surface 128 on the opposite side as was deployed in the earlier embodiments. Internal wall surface 121 in housing element 113 is likely bevelled to approximately the same degree as surface 126 and radially outwardly is located a fluid release hole 130 which communicates with fluid exit passageway 116. Drive shaft 118 is provided with a longitudinal hole 131 along it longitudinal rotational axis 117 which connects via radial hole 132 the region in the internal chamber nearest to seal 134 and bearing 135. Only for the purpose of this description, the rotor member 125 here shown as example deploys two quite different configurations for the cavitation inducing depression zones.

In the first instance, the example for the configuration of the cavitation inducing depression zones may as shown positioned below longitudinal rotational axis 117, comprise five circular rows of openings, commencing with a first circular row of openings 137 nearest to fluid ports 127 and an outermost circular row of openings 138. Preferably, the depth of the openings in each row decreases from the maximum depth nearest the fluid ports 127 to a minimum depth nearest to the tip 139 of the disc 125. To contrast, the configuration of cavitation inducing depression zones shown as example lying directly above longitudinal rotational axis 117 are almost identical to those already described with the exception that each opening 141 includes a small bellmouthed end denoted by reference numeral 140 as well as a small fed or throttle hole 142. Although the opening 141 could be machined to pass right through the axial width of the disc, it is preferable to include a throttle as it will allow some fluid, received from the inlet 115 via holes 131, 132 and the small gap between disc 125 and inner wall 120, to be drawn into the opening 141 to cause destabilization of the pressure condition within openings 141.

Although wall 121 and rotor disc surface 126 are here shown as being slanted so that the gap formed between is substantially uniform right across the diameter of the rotor 125, the gap width could be arranged to become smaller towards the tip of the disc 125 in order to generate a "squeezing" effect on the fluid, increasing thereby the velocity of the fluid exiting near the tip 139 of the rotor providing an impulse on the series of vanes near the tip of the rotor (vanes not shown in this embodiment). Alternatively, in the case of a steam generator, there may be an advantage if the gap were to be increased in size towards the tip of the rotor to take into account the expanding volume of steam.

DETAILED DESCRIPTION OF THE SIXTH EMBODIMENT OF THE INVENTION

Figure 15:
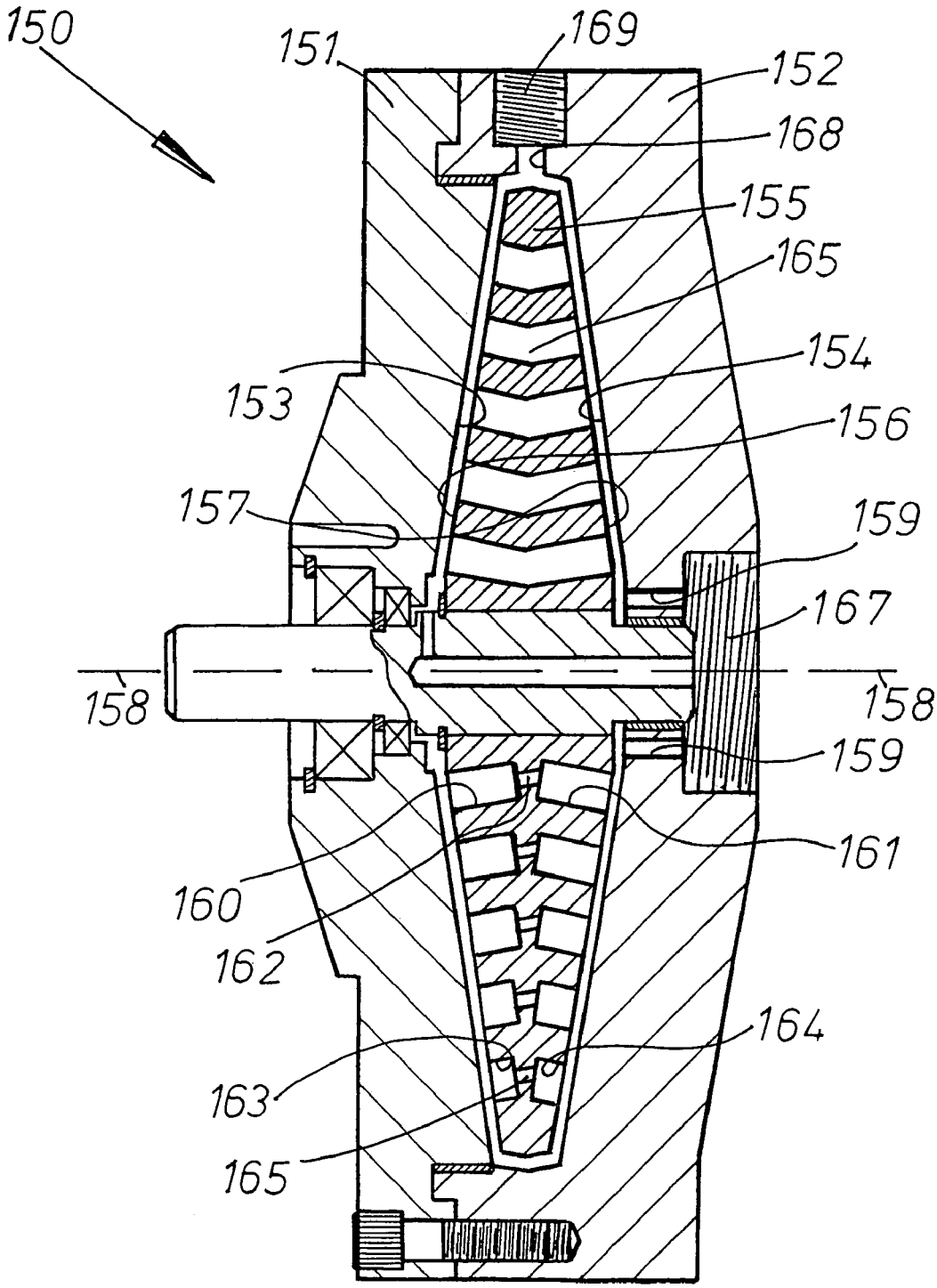
FIG. 15 is a longitudinal sectional view of a device in according to the sixth embodiment of the present invention.

As depicted in FIG. 15, the device denoted by reference numeral 150 differs from those embodiments already described in that housing structure comprising elements 151, 152 are formed with internal walls 153, 154 respectively bevelled. Disc member 155 is provided with bevelled surfaces on both its axial end faces shown as 156, 157 and where in this instance, the gap existing between face 156 and wall interior 153 is approximately of the same magnitude as the gap occurring between face 157 and wall interior 154. Only for the purpose of this description, the rotor member 155 shown as example deploys two quite different configurations for the cavitation inducing depression zones.

In the first instance, the configuration of the cavitation inducing depression zones positioned directly below longitudinal rotational axis 158 comprise five circular rows of bent-axis openings, commencing nearer to fluid ports 159 with a first circular row of openings 160 on disc surface 156 and openings 161 on opposite disc surface 157 and an outermost circular row of openings 163, 164. As shown, bent-axis openings can be fluidly linked together via pressure-equilization holes, or priming holes, or throttle holes, shown as small hole 162 for opposing openings 160,161, and small hole 165 serving opposing openings 163, 164. A reason for including such small holes 162, 165 is to share any heightened or early commencement of cavitation which may occur more pronouncely in one of the two joined openings and to attempt to equalize the pressure condition in the two openings for maximum effect.

When there is no requirement for such openings to be linked together, the relative positions for openings may be staggered like the embodiment shown as FIG. 9. In this case, the openings can penetration deeper into the double-bevelled disc 155 than is the case with the flat-sided rotor disc. Furthermore, the same openings may be extended to completely pass through the axial width of the disc as is here shown as example with the configuration of cavitation inducing depression zones lying above longitudinal rotational axis 158. Such openings may be fashioned as straight holes or preferably as is here shown, configured as a dog-leg opening 165. The inclination of such dog-leg openings helps the fluid caught inside to be expelled by the action of centrifical force for the creation of an enhanced vacuum pressure conditions within these openings. Housing member 152 is provided with inlet 167 and radial hole 168 which leads to exit 168. It should be noted that it is not an intention to limit this aspect of the invention to this particular configuration of dog-leg openings and bevelled rotor surfaces. For instance, the longitudinal axes of the openings could configured parallel and coaxial and be deployed on rotor surfaces that lie perpedicular to the rotational axis of the drive shaft.

DETAILED DESCRIPTION OF THE SEVENTH EMBODIMENT OF THE INVENTION

Figure 16:
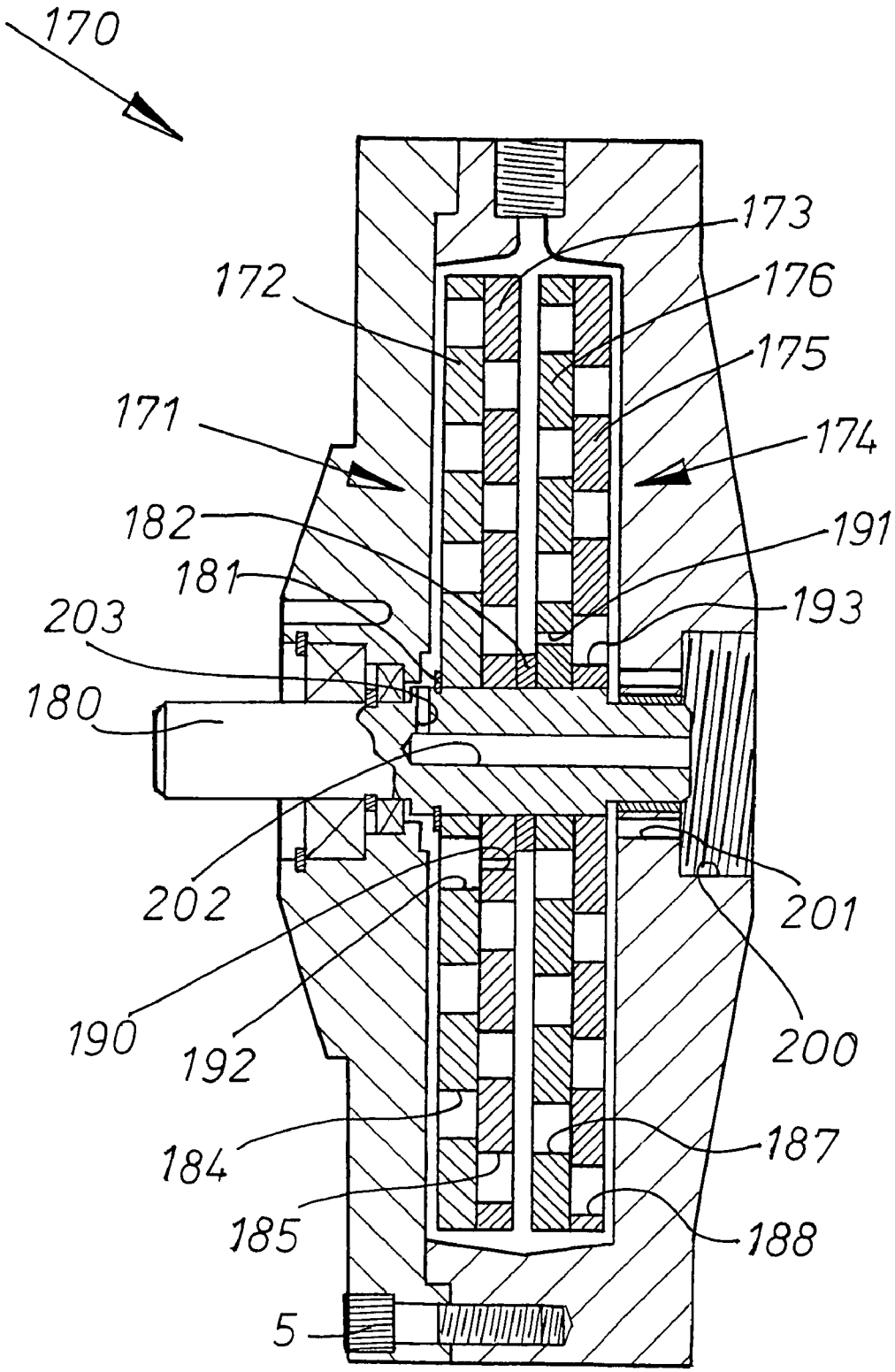
FIG. 16 is a longitudinal sectional view of a device in according to the seventh embodiment of the present invention.

FIG. 16 discloses dual rotor disc sets for the device denoted by reference numeral 170. Here the left hand rotor disc set 171 comprises two perforated disc-shaped elements 172, 173 which preferably are threaded in the same direction on drive shaft 180 as which the drive shaft 180 rotates. The right hand rotor disc set 174 comprises two perforated disc-shaped elements 175, 176 which preferably are threaded in the counter direction. Circlip 181 on drive shaft 180 may be used to set the axial position of disc element 172, and where spacer 182 located between respective disc elements 173, 176 is there to ensure the necessary gap spacing between disc elements 173, 176. As was the case for the third embodiment of the invention shown as FIG. 9, openings shown as 184, 185 in this particular disc sets 171 are shown staggered from each other to ensure there is no cross leakage, and similarly, openings shown as 187, 188 are similarly staggered in disc set 174. However to contrast with the third embodiment, each of disc elements 173, 176 is provided with a series of small holes shown as 190, 191 respectively, these being arranged to interface with respective openings 192, 193 thereby enabling fluid in opening 192 to be routed through hole 190 to access the gap spacing between discs 173, 176. Similarly, fluid in opening 193 is routed through hole 191 to reach the gap spacing between discs 173, 176. As example, when there are six such openings as opening 193 for the inner circular row nearest fluid ports 201 in disc element 175, then there are six holes as hole 191 in disc element 176 and the same is true when there are six openings in the inner circular row of openings in disc 172. Were such holes not included, the gap space between the discs 173, 176 and the openings there positioned, shown here as openings 185, 187 would not operate as intended as they would be starved from receiving fluid from fluid ports 201 and radial drilled hole 203, respectively.

DETAILED DESCRIPTION OF THE EIGHTH EMBODIMENT OF THE INVENTION

Figure 17:
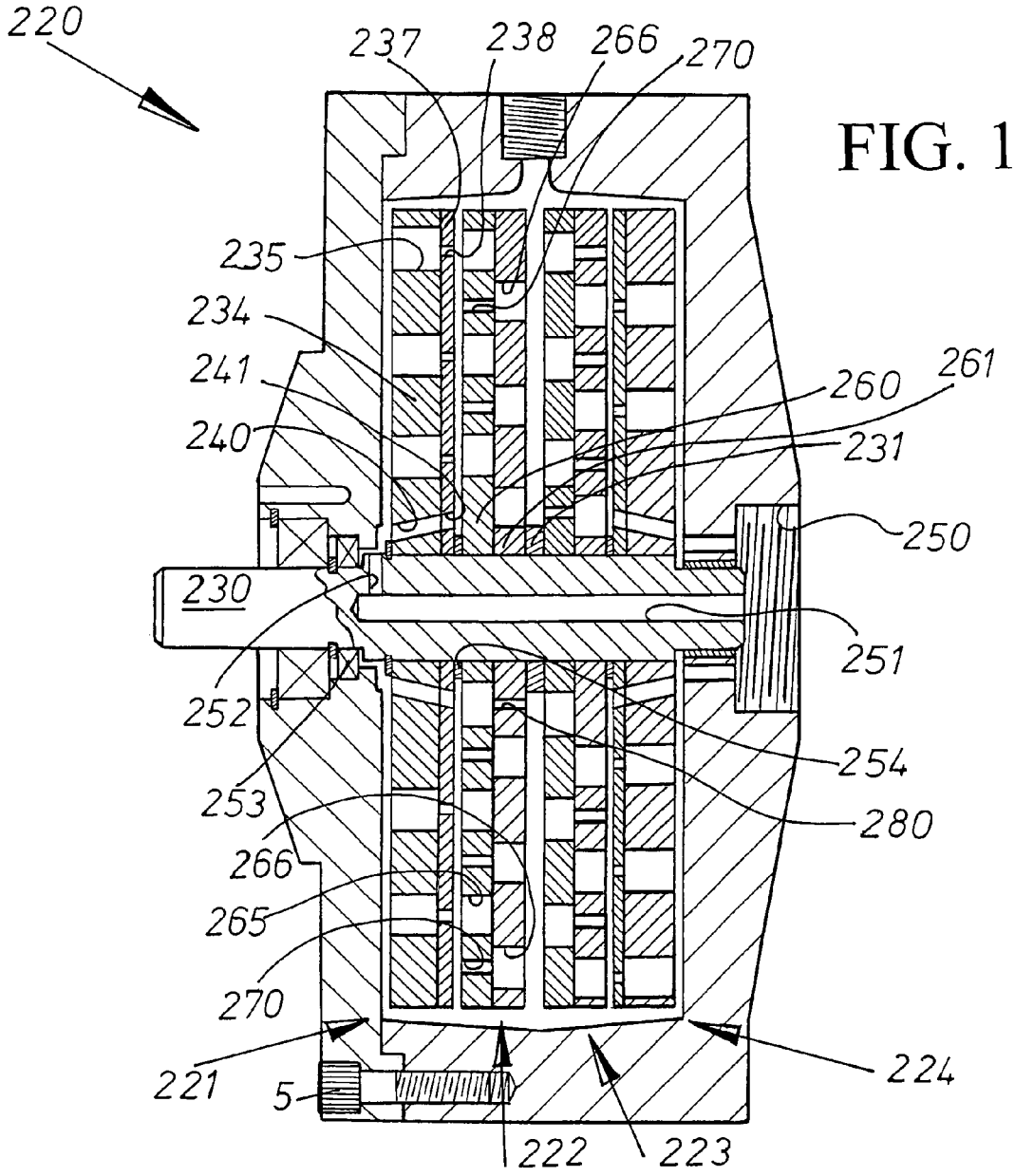
FIG. 17 is a longitudinal sectional view of a device in according to the eighth embodiment of the present invention.

FIG. 17 discloses a quartet of rotor disc sets for the device denoted by reference numeral 220, these rotor sets denoted as 221, 222, 223, 224, are in many ways quite similar to the seventh embodiment of the invention previously described. Here rotor disc sets 221, 222 are threaded on drive shaft 230 in the same direction as the rotational direction of drive shaft 230 whereas rotor disc sets 223, 224 are threaded counter to the rotational direction of drive shaft 230. Spacer 231 positioned between rotor disc sets 222, 223 ensures that the rotation of drive 230 has the effect of loading rotor disc sets 221, 222 onto one side of the spacer 231 to balancing the loading received from rotor-disc sets 223, 224 on the opposite side of spacer 231.

Rotor disc sets 221,224, although on opposite sides of the device 220 are identical, and as rotor disc sets 222, 223 are also identical with respect to each other, it will suffice just to describe the two most left-sided rotor disc sets 221, 222.

Rotor disc set 221 comprises a perforated disc-shaped element 234 provided with a plurality of openings 235, and preferably configured over several circular rows in a manner that has already been described in earlier embodiments. However, here the type of disc element joined to it, this being circular blanking plate 237 is also provided a plurality of pierced holes 238 and which directly match in number the number of openings 235 in disc element 234. As shown, respective angled feeder holes 240, 241 are provided in both disc element 234 and blanking plate 237. Fluid entering the device 220 at inlet 250 and the quantity which then is passed through drilled holes 251, 252 in drive shaft 230 to enter internal chamber at a location nearer to seal 253, is able not only to travel in a manner described for the first embodiment, namely spirally outwardly across the various openings 235 in disc 234 to produce heat, but also via these angled feeder holes 240, 241, to reach the gap between rotor disc sets 21, 222. The gap is preferably set by spacer washer 254. Here centrifugal forces on the fluid in this region cause it to be moved radially outwardly across the various openings 265 between disc elements 237, 260, which provided they are at lower or vacuum pressure levels, can contribute in the generation of heat in the fluid passing through the device 220.

Perforated disc-shaped element 260 forms one element of rotor disc set 222, the other element being perforated disc-shaped element 261, and which also carries a plurality of openings 266. In order that fluid received via angled holes 240 can also get to perforated disc-shaped element 261, two pathways are provided. Firstly disc element 260 is provided with a number of small throttle holes shown as 270 which allow fluid to be fed from the left hand side of the disc set 222 to the opposite side by passing through holes 270 and openings 266. Secondly, perforated disc element 261 is provided with a single circular array of throttle holes shown as 280 which are positioned slightly radially outwards of spacer 231. As a result, fluid entering the gap between disc sets 221, 222 via angles holes 240, 241 is able to access via these throttle holes 270, 280 to the gap existing between rotor disc sets 222, 223, and thereby a degree of cavitation, depending on the throttle, can occur in openings 266 which can help towards contributing to the amount of heat generated in the fluid passing through the device 220. This four rotor set embodiment can be further modified through the omission of throttle holes 280. In this case, any fluid initially residing in the gap between disc sets 222, 223 and lying radially inwards of the innermost positioned openings 266 in perforated disc element 261 and radially outwards of spacer 231 would because of centrifugal force, be expelled such that inner annular space in the gap region would become a vacuum. Incoming fluid via holes 266 and openings 266 in disc elements 260, 261, respectively, entering near this vaccum pressure region between disc elements 222, 223 would then be caused to be rapidly heated.

This embodiment of the invention as well as the previous seventh embodiment differ from the earlier embodiments of the invention in that the fluid is channelled into spaces existing inside the spinning disc assembly, and in these locations where there is no differential surface speed as was the case with earlier embodiment where the surface of the disc with its array of openings was confronting by a static wall surface of the interior of the housing. As a result, a trigger or catalyst is required to set off a chain of cavitational events for those openings positioned in disc members which are not opposed by non-moving fluid boundary surfaces, and this is here achieved through interlinking the rotor sets through a number of relatively small priming or throttle holes. As shown, the central longitudinal holes 251 in drive shaft 230 is of uniform cross section along its length, but in practice, would be more likely to be a stepped hole to ease the production of such a deeply drilled hole. Such a stepped hole may also be incorporated in the drive shaft of earlier embodiments.

The clearance gap in the various embodiments described above, especially when there is no fluid movement required over a particular surface face of a disc element, for instance, where fluid there is only used to cool and lubricate that region adjacent to the shaft seal, is shown larger than might normally be practical in order to better distinquish between the separate components in these drawings. When appropriate, a mechanical seal may be deployed in this clearance gap, the mechanical seal located in a position between the surface face of the disc element and the interior wall of the housing, and radially outwardly of the threaded portion of said drive shaft.

In practical terms, at least one of the end faces of the rotor disc is arranged to carry a plurality of openings over this particular surface, and in one form of the rotor these being purposely spaced in several rows of varying radial distance from the central axis of said rotor. Ideally, there would be as many openings as possible, configured on the face or faces of the disc, providing that the disc retains sufficient strength integrity, whilst keeping the number reasonable for economic production costs. In this regard, as a practical matter, it is envisioned, for the sake of simplifying manufacture, to space the openings such that the distance as measured between the edge of each adjacent opening is greater than the diameter of the opening. However this does not have always to be the case, an example shown is the disc having the larger bellmouthed-shaped openings described in FIGS. 12 & 13. These openings may have a standard or constant measurement of diameter and depth or may alternatively be sized such that the diameters and depths vary in a degree depending on the radial distance, as measured from the central axis of the rotor. For instance, a typical rotor face design may have a first row of relatively small sized diameter openings with shallow depths, the next row having openings of increased relatively size, and so on, such the outermost row of openings on the disc face encompass the largest sizings for diameter and depth. Typically, the range of sizes for diameter may range from 4 mm to 12 mm in a 120 mm diameter disc, although this diameter is not critical and may be varied, an example shown is the disc having the larger bellmouthed-shaped openings described in FIGS. 12 & 13 where the diameter of the opening on the surface of the disc is approximately 22 mm. The diameter of the disc itself may be chosen at will depending on the desired application. Although depths may vary, standard depths for all rows of openings are to be preferred, diameters and depths may be chosen to suit the application and the degree of heat output required, whether it be hot water or steam, from a particular machine in question. Typically, the depths of the opening will be in the same range as the diameters, ie., from about 4 mm to about 12 mm, but it is to be understood that the depth of a given hole need not match its diameter as has been demonstrated with certain deeper holes in the fifth and sixth embodiments of the invention, or compartively shallow holes in the case of the bellmouthed-shaped openings of FIG. 12. When required, interspersed with said rows of bottom-ended openings, which by communicating or linking both end faces of the rotor, cause an equilization in the pressure condition in the two adjacent regions of each rotor disc. As the rotor discs or discs will be operating at high rotational speeds, there is the likelihood for additional openings, in the form of drilled holes, to be included, these may become the pressure equalization ducts, in order to balance the center of gravity. As has been demonstrated in FIG. 7, the aforementioned multi-circular arrays of openings can further be modified such that one or more rows are arranged to follow a spiral path starting near the center and expanding outwardly to the periphery of the disc. A certain number or indeed all openings, may be arranged such their longitudinal axes are inclined with respect to the axis of rotation of the disc. When openings are desired on both side faces of a disc, these are arranged in an alternating pattern such that many more such openings can thereby be included on a single disc, so long as the spacing is such that the alternate openings do not intersect each other. While a circular shape of opening is the most economic shape to produce, non circular cross-sections could be used, especially when the openings in the discs are performed by punching for a stamped disc or for that matter, a sintered powder metal disc.

As used herein, the term "fluid heating" contemplates the heating of either liquids or gases, although in practice the heating of liquids will be more commonly performed. In the context of heating liquids, it will be expressly understood that the heating device and method according to the invention include not only the generation of a hotter liquid, but also the phase transformation of the liquid into a gas. Therefore, the heat generating device and method as described are also steam generators, wherein the difference between raising the temperature of a liquid versus generating a vapor phase of the liquid may be controlled by the speed of the rotation of the rotary disc(s) and the design of the cavitation-inducing surface irregularities.

What is claimed is:

1. A fluid heating device comprising a housing having an internal chamber and a fluid inlet and a fluid outlet in fluid communication with said internal chamber, said fluid inlet and said fluid outlet each opening exteriorly of said housing; a rotor comprising at least one rotary disc disposed in said internal chamber and mounted for rotation within said internal chamber about an axis of rotation, said rotor having a maximum radial extent greater than its maximum axial extent, said rotor having first and second end faces facing more axially than radially and a peripheral outer surface; a drive shaft for imparting mechanical power to said rotor, and said rotor drivingly connected to said drive shaft; at least two bearings disposed in said housing and said drive shaft rotatably supported in said housing by said at least two bearings where one respective bearing is disposed nearer the first end face and another respective bearing is disposed nearer the second end face; a plurality of openings opening on at least one of said first and second end faces and disposed radially outwardly from said axis of rotation and radially inwardly of said peripheral outer surface, said openings confronting fluid entering said chamber, wherein rotation of said rotary disc causes said plurality of openings to impart heat-generating cavitation to a fluid entering said chamber.

2. The device according to claim 1, wherein said plurality of openings comprises openings passing through the entire thickness of said at least one rotary disc.

3. The device according to claim 1, wherein said plurality of openings comprises blind openings passing through less than the entire thickness of said at least one rotary disc and having bottoms formed within said at least one rotary disc.

4. The device according to claim 1 wherein said plurality of openings comprises plural concentric circular arrays of openings formed on said at least one of said first and second end faces.

5. The device according to claim 1 wherein said plurality of openings comprises at least one spiral array of openings formed on said at least one of said first and second end faces.

6. The device according to claim 1 wherein said plurality of openings comprises an irregular array of openings formed on said at least one of said first and second end faces.

7. The device according to claim 1 wherein said plurality of openings comprises plural radially-extending rows of openings formed on said at least one of said first and second end faces.

8. The device according to claim 1, further comprising a rotor assembly comprising said at least one rotary disc together with at least one additional rotary disc mounted for rotation therewith, said at least one additional rotary disc having third and fourth end faces facing more axially than radially and a peripheral outer surface, a plurality of cavitation-inducing openings opening on at least one of said third and fourth end faces and disposed radially outwardly from said axis of rotation and radially inwardly of said peripheral outer surface, said at least one rotary disc and said at least one additional rotary disc being axially spaced apart from one another to define a subchamber within said chamber.

9. The device according to claim 1 wherein at least one of said first and second faces is disposed perpendicular to said axis of rotation.

10. The device according to claim 1 further comprising at least one fluid port disposed in said housing and connecting said at least one fluid inlet to said internal chamber, said at least one fluid port has its longitudinal axis disposed parallel to said axis of rotation.

11. The device according to claim 9 wherein said rotary disc comprises a perforated element and a plate element, said perforated element and said plate element joined together and rotatable in unison with said drive shaft.

12. The device according to claim 1 wherein at least one of said first and second end faces is angularly inclined relative to said axis of rotation.

13. The device according to claim 1 wherein said fluid inlet is disposed radially closer to said axis of rotation than said fluid outlet.

14. The device according to claim 1 wherein said at least one rotary disc comprises a perforated element and a plate element.

15. The device according to claim 14 wherein said perforated element is manufactured as a stamping.

16. A fluid heating device comprising a housing; a chamber in said housing and a rotor comprising at least one rotary disc disposed in said chamber and dividing said chamber into first and second regions, the first region lying axially to one side of said rotary disc element and the second region lying to the opposite side of said rotary disc element, said rotor having a maximum radial extent greater than its maximum axial extent; a drive shaft rotatably supported in said housing for imparting mechanical energy to said rotor, said drive shaft having a longitudinal axis of rotation and said rotary disc mounted on said drive shaft for rotation about said longitudinal axis; at least two bearings disposed in said housing and where one respective bearing is disposed nearer the first region and another respective bearing is disposed nearer the secondn region; a fluid inlet and a fluid outlet in fluid communication with said chamber, said fluid inlet and fluid outlet each opening exteriorly of said housing; said rotary disc having a plurality of openings opening on at least a face thereof and extending into the interior of said at least one rotary disc in a substantially perpendicular direction with respect to said axis of rotation, said openings confronting fluid entering at least one of said first and second regions, wherein rotation of said rotary disc causes said plurality of openings to impart heat-generating cavitation to a fluid entering said at least one of said first and second regions.

17. The fluid heating device according to claim 16 wherein said fluid inlet lies nearer to said longitudinal axis than said fluid outlet.

18. The fluid heating device according to claim 16 further comprising a fluid port in said housing and where said fluid port is arranged to connect said fluid inlet to one of said first and second regions.

19. The device according to claim 16 wherein said at least one rotary disc comprises a perforated element and a plate element.

20. The device according to claim 16, further comprising an additional plurality of openings opening on another face of said rotary disc and extending into said interior of said rotary disc in a substantially perpendicular direction with respect to said axis of rotation, wherein respective said plurality of openings disposed on opposing faces of said rotary disc are disposed in a staggered formation.

21. The device according to claim 18 further comprising fluid passageways disposed in said drive shaft, said fluid passageways connecting said fluid inlet to the other one of said first and second regions.

22. A fluid heating device comprising a housing; a chamber in said housing and a rotor comprising at least one rotary disc disposed in said chamber, said at least one rotary disc having a maximum radial extent greater than its maximum axial extent and dividing said main chamber into a centrally disposed inlet chamber, a radially outwardly disposed exhaust chamber and an intermediate fluid heat generating chamber; a drive shaft rotatably supported in said housing by a pair of bearings and where said rotor is positioned in between said pair of bearings, said drive shaft having an inner end disposed in said housing and an outer end disposed outwardly of said housing for receiving power input, said drive shaft for imparting mechanical energy to said at least one disc and having a longitudinal axis of rotation and said at least one disc mounted on said drive shaft for rotation about said longitudinal axis; a fluid inlet disposed in said housing and communicating with said inlet chamber; a fluid outlet disposed in said housing and lying radially outwardly of said fluid inlet, said fluid outlet communicating with said exhaust chamber; said fluid heat generating chamber comprising at least one pair of first and second opposing fluid boundary defining surfaces axially spaced apart from one another along at least the substantive radial length of said at least one rotary disc and where the second boundary defining surface comprises an interior housing wall; said at least one rotary disc having a plurality of openings opening on at least a face thereof and extending into the interior of said at least one rotary disc in a substantially perpendicular direction with respect to said axis of rotation, said plurality of openings disposed to open on the first boundary defining surface, and wherein rotation of said at least one disc element causes said plurality of openings to impart heat-generating cavitation to a fluid entering said fluid heat generating chamber.

23. The device according to claim 22 wherein said at least one pair of first and second opposing fluid boundary defining surfaces provide the sole pathway for fluid on entering said inlet chamber to reach said exhaust chamber, and wherein said at least a face thereof is disposed perpendicular to said longitudinal axis.

24. The device according to claim 22 further comprising fluid passageways disposed in said drive shaft, said fluid passageways connecting said fluid inlet to that one of said pair of fluid boundary surfaces disposed furthermost from said fluid inlet.

25. The device according to claim 22 wherein said at least one rotary disc comprises a perforated element and a plate element, said perforated element and said plate element joined together and rotatable in unison with said drive shaft.

26. The device according to claim 22 further comprising a fluid seal disposed in said housing and surrounding said drive shaft, said seal residing in said housing opposite to said fluid inlet, and where said inner end of said drive shaft is exposed to said fluid inlet.

27. A method of heating fluids, comprising causing a fluid to enter at least one inlet passage of a device comprising a housing having an internal chamber, a rotary disc mounted for rotation within said chamber about an axis of rotation, said rotary disc having a maximum radial extent greater than its maximum axial extent, said rotor disc having first and second end faces facing more axially than radially and a peripheral outer surface, a drive shaft for imparting mechanical power to said rotary disc, and said rotary disc drivingly connected to said drive shaft, at least two bearings disposed in said housing and said drive shaft rotatably supported in said housing by said at least two bearings where one respective bearing is disposed nearer the first end face and another respective bearing is disposed nearer the second end face; at least one inlet passage and at least one outlet passage formed in said housing, said rotor disc having a plurality of openings opening on at least one of said first and second faces and disposed radially outwardly of said axis of rotation and radially inwardly of said peripheral outer surface, said plurality of openings extending into the interior of said rotary disc in a substantially perpendicular direction with respect to said axis of rotation, said openings confronting fluid entering said chamber, while rotating said rotary disc at a speed sufficient to cause said plurality of openings to impart heat-generating cavitation to a fluid entering said chamber.

28. The method according to claim 27, wherein said device further comprises a rotary disc assembly comprising said rotary disc together with at least one additional rotary disc mounted for rotation therewith, said at least one additional rotary disc comprising a plurality of cavitation-inducing openings opening on at least a face thereof and extending into the interior of said at least one additional rotary disc in a substantially perpendicular direction with respect to axis of rotation, said rotary disc and said at least one additional rotary disc being axially spaced apart from one another to define a subchamber within said chamber, and wherein said method further comprising causing said fluid to enter said subchamber while rotating said rotary disc assembly.

* * * * *